US007394440B2

(12) United States Patent
Goldberg

(10) Patent No.: US 7,394,440 B2
(45) Date of Patent: Jul. 1, 2008

(54) THREE-DIMENSIONAL ANTENNA FABRICATION FROM MULTIPLE TWO-DIMENSIONAL STRUCTURES

(75) Inventor: Steven J. Goldberg, Downingtown, PA (US)

(73) Assignee: InterDigital Technology Corporation, Wilmington, DE (US)

( * ) Notice: Subject to any disclaimer, the term of this patent is extended or adjusted under 35 U.S.C. 154(b) by 57 days.

(21) Appl. No.: 11/343,398

(22) Filed: Jan. 31, 2006

(65) Prior Publication Data

US 2006/0192721 A1 Aug. 31, 2006

Related U.S. Application Data

(60) Provisional application No. 60/651,608, filed on Feb. 10, 2005.

(51) Int. Cl.
*H01Q 21/00* (2006.01)
*H01Q 19/10* (2006.01)

(52) U.S. Cl. ..... 343/893; 343/834; 343/835; 343/836; 343/837

(58) Field of Classification Search ..... 343/893, 343/834, 835, 836, 837
See application file for complete search history.

(56) References Cited

U.S. PATENT DOCUMENTS

2002/0015000 A1 * 2/2002 Reece et al. ..... 343/795

* cited by examiner

*Primary Examiner*—Hoang V Nguyen
*Assistant Examiner*—Robert Karacsony
(74) *Attorney, Agent, or Firm*—Allen, Dyer, Doppelt, Milbrath & Gilchrist, P.A.

(57) ABSTRACT

A method for making an antenna array includes forming a ground plane having spaced apart openings extending therethrough, and forming a first antenna board having a support section and spaced apart first legs extending outwardly from the support section. An antenna element is formed on each outwardly extending first leg. A second antenna board having a support section and at least one second leg extending outwardly from the support section is formed. An antenna element is formed on the at least one outwardly extending second leg. The outwardly extending first legs are inserted through a corresponding number of openings in the ground plane. Similarly, the at least one outwardly extending second leg is inserted through one of the openings in the ground plane. The first and second legs are inserted so that their respective support sections contact the ground plane.

30 Claims, 6 Drawing Sheets

THREE-DIMENSIONAL ANTENNA FABRICATION FROM MULTIPLE TWO-DIMENSIONAL STRUCTURES

RELATED APPLICATION

This application claims the benefit of U.S. Provisional Application Ser. No. 60/651,608 filed Feb. 10, 2005, the entire contents of which are incorporated herein by reference.

FIELD OF THE INVENTION

The present invention relates to the field of antennas, and more particularly, to a method for making a three-dimensional antenna array using two-dimensional structures.

BACKGROUND OF THE INVENTION

Antenna arrays for advanced applications are often constructed in a three-dimensional configuration. Example antenna arrays include beam forming antennas having three or more antenna elements and MIMO antenna arrays. An example three-dimensional antenna array 50 is illustrated in FIG. 1. The antenna array 50 includes an active center antenna element 52, and three passive antenna elements 54 extending outward from a dielectric substrate 56. The passive antenna elements 54 include upper and lower conductive segments 54(1) and 54(2).

The cost to individually produce the active and passive antenna elements 52 and 54, and to assemble the antenna array 50 for small devices is significant when compared to the overall cost of the devices receiving such an antenna array. Moreover, it is also time consuming to assemble three-dimensional antenna arrays.

SUMMARY OF THE INVENTION

In view of the foregoing background, it is therefore an object of the present invention to provide a relatively fast and inexpensive way to fabricate and assemble a three-dimensional antenna array.

This and other objects, features, and advantages in accordance with the present invention are provided by a method for making an antenna array comprising forming a ground plane having a plurality of spaced apart openings extending therethrough, forming at least one first antenna board having a support section and a plurality of spaced apart first legs extending outwardly from the support section, and forming an antenna element on each outwardly extending first leg. A second antenna board having a support section and at least one second leg extending outwardly from the support section is formed. An antenna element is formed on the at least one outwardly extending second leg.

The method further comprises inserting the spaced apart outwardly extending first legs through a corresponding number of openings in the ground plane. The first legs are inserted so that the support section of the first antenna board contacts the ground plane, and each outwardly extending first leg forms a "T" with respect to the ground plane. The outwardly extending second leg is also inserted through one of the plurality of openings in the ground plane. The second leg is inserted so that the support section of the second antenna board contacts the ground plane, and the outwardly extending second leg also forms a "T" with respect to the ground plane.

The three-dimensional antenna array is formed in a relatively fast and inexpensive way since the array is initially formed as multiple two-dimensional structures.

The two-dimensional structures are then assembled to form the three-dimensional antenna array.

For the first antenna board, each antenna element is divided into upper and lower conducting elements, with the upper conducting element being on one of the first legs and the lower conducting element being on a portion of the support section opposite the first leg. The support section may be continuous between the portions of the support sections opposite the first legs. For the second antenna board, the at least one antenna element is divided into upper and lower conducting elements, with the upper conducting element being on the at least one second leg and the lower conducting element being on a portion of the support section opposite the second leg.

In one embodiment, for the second antenna board, the at least one second leg extending outwardly from the support section of the second antenna board may comprise a pair of second legs, with an antenna element formed on each second leg. One of the antenna elements may comprise an active antenna element and the other antenna element may comprise a passive antenna element.

In another embodiment, for the second antenna board, the antenna element formed on the at least one second leg comprises a passive antenna element divided into upper and lower conducting elements, with the lower conducting element being on the second leg and the upper conducting element being on a portion of the support section opposite the second leg. Forming the second antenna board may further comprise forming an alignment section extending from the support section. The alignment section is to be inserted into one of the openings in the ground plane when the at least one second leg is inserted through one of the openings in the ground plane. An active antenna element is formed on a portion of the support section opposite the alignment section.

The first and second antenna boards may be orthogonal to one another when their respective supports sections are contacting the ground plane. The first and second antenna boards are thus contacting one another for forming a T-shaped arrangement.

The method further comprises providing at least one electrical component and at least one connector on the ground plane, with the at least one electrical component being connected to at least one of the antenna elements. In one embodiment, the antenna elements comprises active antenna elements so that the antenna array forms a phased array. In another embodiment, the antenna elements comprise at least one active antenna element and a plurality of passive antenna elements for forming a switched beam antenna.

Another aspect of the invention is directed to an antenna array formed as a result of the above described methods.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
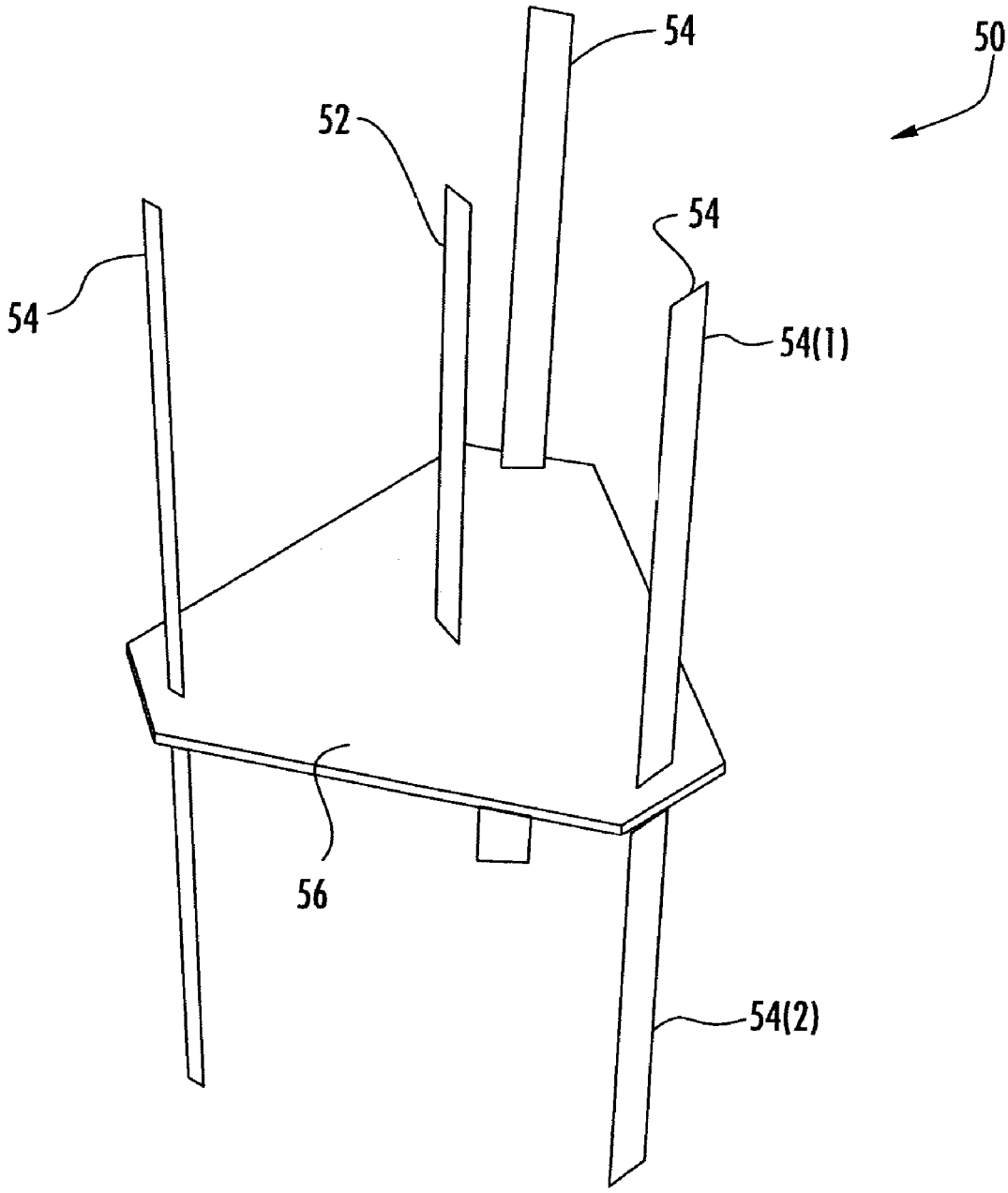
FIG. 1 (PRIOR ART)
FIG. 1 is a perspective view of a three-dimensional antenna array formed in accordance with the prior art.

In accordance with the present invention, the parts for a three-dimensional antenna array are initially formed as a plurality of two-dimensional structures. The two-dimensional structures are then assembled to form the three-dimensional antenna array. For purposes of illustrating the present invention, the antenna array 50 shown in FIG. 1 will be formed using two-dimensional structures.

Figure 2:
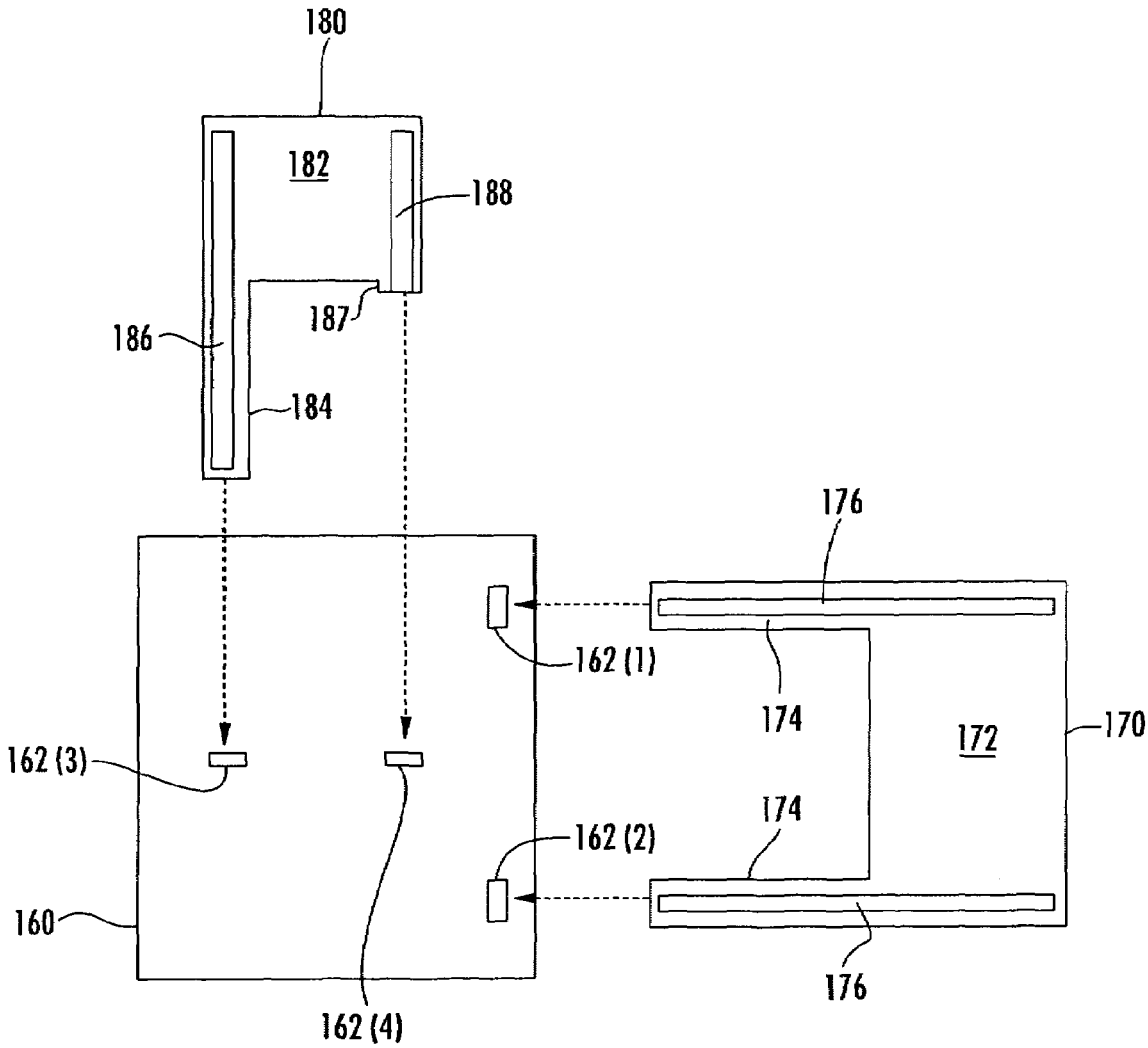
FIG. 2 is a view of the two-dimensional structures used to assemble the three-dimensional antenna array in accordance with the present invention.

This particular antenna array is only an example implementation. Antenna arrays having different numbers of antenna elements and spatial orientations can be constructed by the same techniques disclosed below. Three separate two-dimensional structures are used to form the illustrated antenna array 150 in accordance with the present invention. The two-dimensional structures 160, 170 and 180 used to assemble the three-dimensional antenna array 150 are shown in FIG. 2.

A ground plane 160 has a plurality of openings 162(1)-162(4) extending therethrough, and is formed on a dielectric substrate 164. The openings 162(1)-162(4) also extend through the dielectric 164. The first antenna board 170 has a support section 172 and a plurality of spaced apart first legs 174 extending outwardly from the support section. An antenna element 176 is on each first leg 174.

A second antenna board 180 also has a support section 182 and at least one second leg 184 extending outwardly from the support section. An antenna element 186 is on the at least one outwardly extending second leg 184. As will be discussed in greater detail below, another antenna element 188 is also formed on the support section 182, but is not formed on an outwardly extending second leg. Antenna element 188 corresponds to the active antenna element 52 shown in FIG. 1.

Electronic ink may be used to lay down the antenna elements 176, 186 and 188 in two-dimensions on the respective first and second antenna boards 170, 180. The use of electronic ink to create two-dimensional antenna elements is well known to those skilled in the art.

Figure 3:
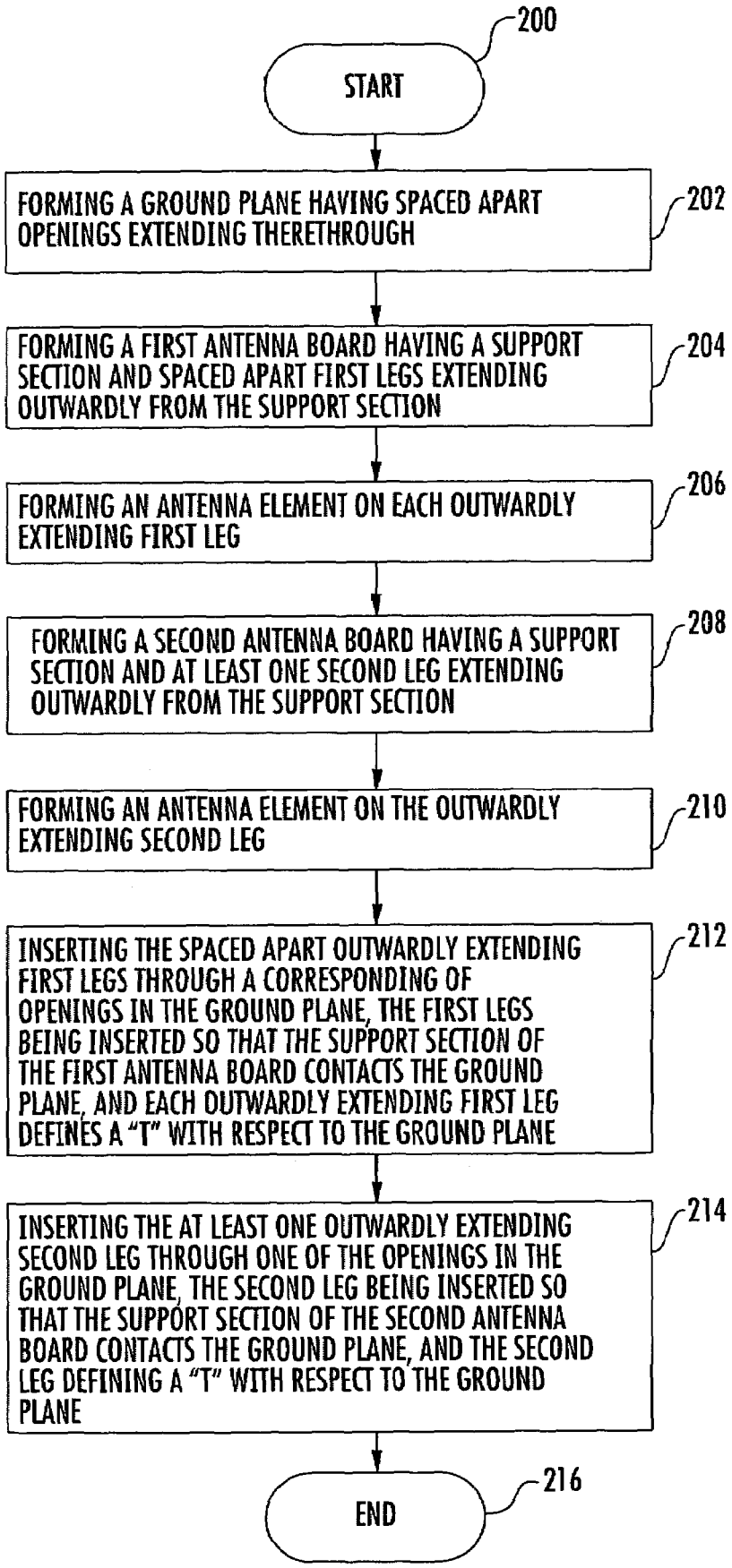
FIG. 3 is a flow chart for making a three-dimensional antenna array from two-dimensional structures in accordance with the present invention.

A flow chart for making the antenna array 150 in accordance with the invention is provided in FIG. 3, and will be referenced below. Dashed lines indicate how the first and second antenna boards 170, 180 are to be inserted into the openings 162(1)-162(4) extending through the ground plane 160. Electrical components 300, 302 and connectors 314 typically coupled to the antenna elements 176, 186 and 188 will be discussed when reference is made to FIG. 5 and FIGS. 6*a*-6*c*.

The method for making such an antenna array 150 comprises, from the start (Block 200), of forming a ground plane 160 having a plurality of spaced apart openings 162(1)-162(4) extending therethrough at Block 202. A first antenna board 170 is formed at Block 204 having a support section 172 and a plurality of spaced apart first legs 174 extending outwardly from the support section. An antenna element 176 is formed on each outwardly extending first leg at Block 206.

The method continues forming at Block 208 a second antenna board 180 having a support section 182 and at least one second leg 184 extending outwardly from the support section. An antenna element 186 is formed on the at least one outwardly extending second leg 184 at Block 210.

The spaced apart outwardly extending first legs 176 are inserted through a corresponding number of openings 162(1) and 162(2) in the ground plane 160 at Block 212. The first legs 176 are inserted so that the support section 172 of the first antenna board 170 contacts the ground plane 160, and each outwardly extending first leg forms a "T" with respect to the ground plane.

Similarly, the at least one outwardly extending second leg 184 from the second antenna board 180 is inserted through one of the plurality of openings 162(3) in the ground plane 160 at Block 214. The second leg 184 is inserted so that the support section 182 of the second antenna board 180 contacts the ground plane 160. The second leg 184 forms a "T" with respect to the ground plane.

Even though antenna element 188 is not formed on an outwardly extending second leg 184 as is the case for antenna element 186, the second antenna board 180 has an alignment section 187 extending from the support section 182. The antenna element 186 is formed on the alignment section 187, and the alignment section is inserted into a corresponding opening 162(4) in the ground plane 160. The alignment section 187 guides the second antenna board 180 into its proper position on the ground plane 160, as well as allowing the antenna element 188 to be electrically connected.

Figure 4A:
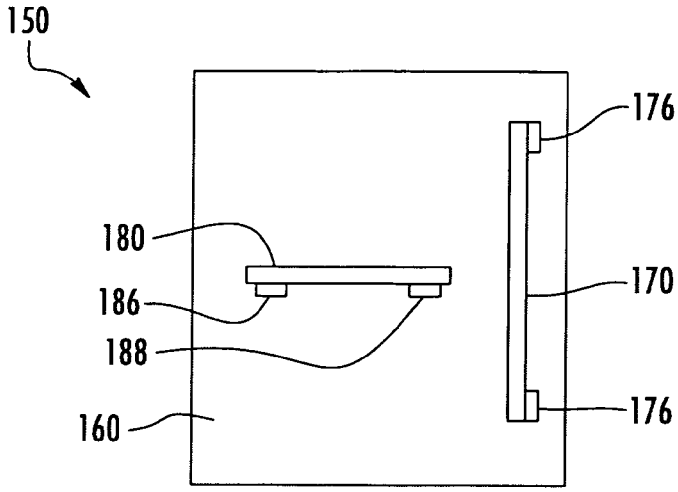
FIGS. 4*a*-4*c* are top and side views of the three-dimensional antenna array assembled from the two-dimensional structures shown in FIG. 2.
Figure 4B:
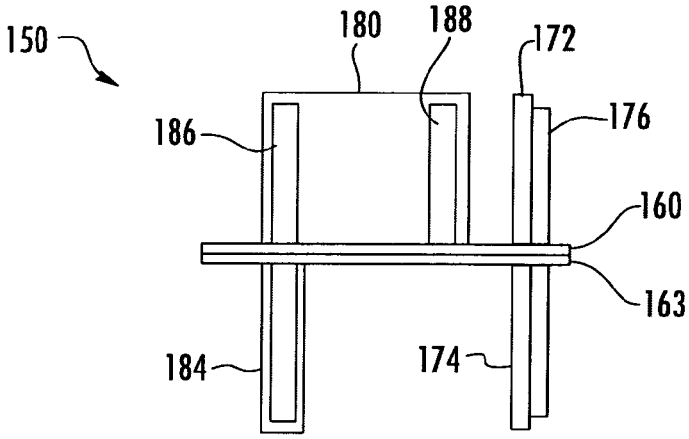
Figure 4C:
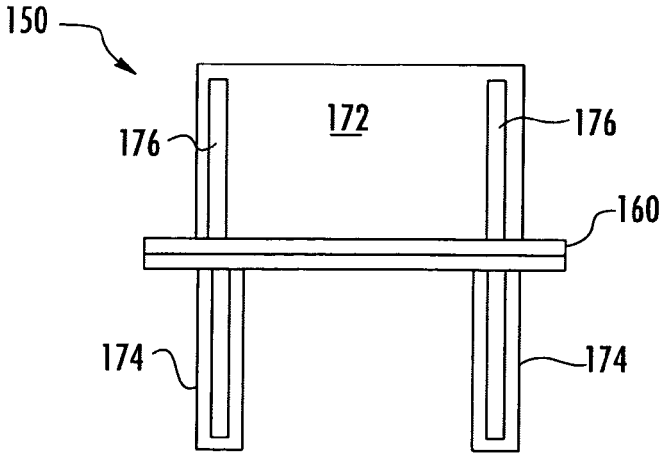
Figure 5:
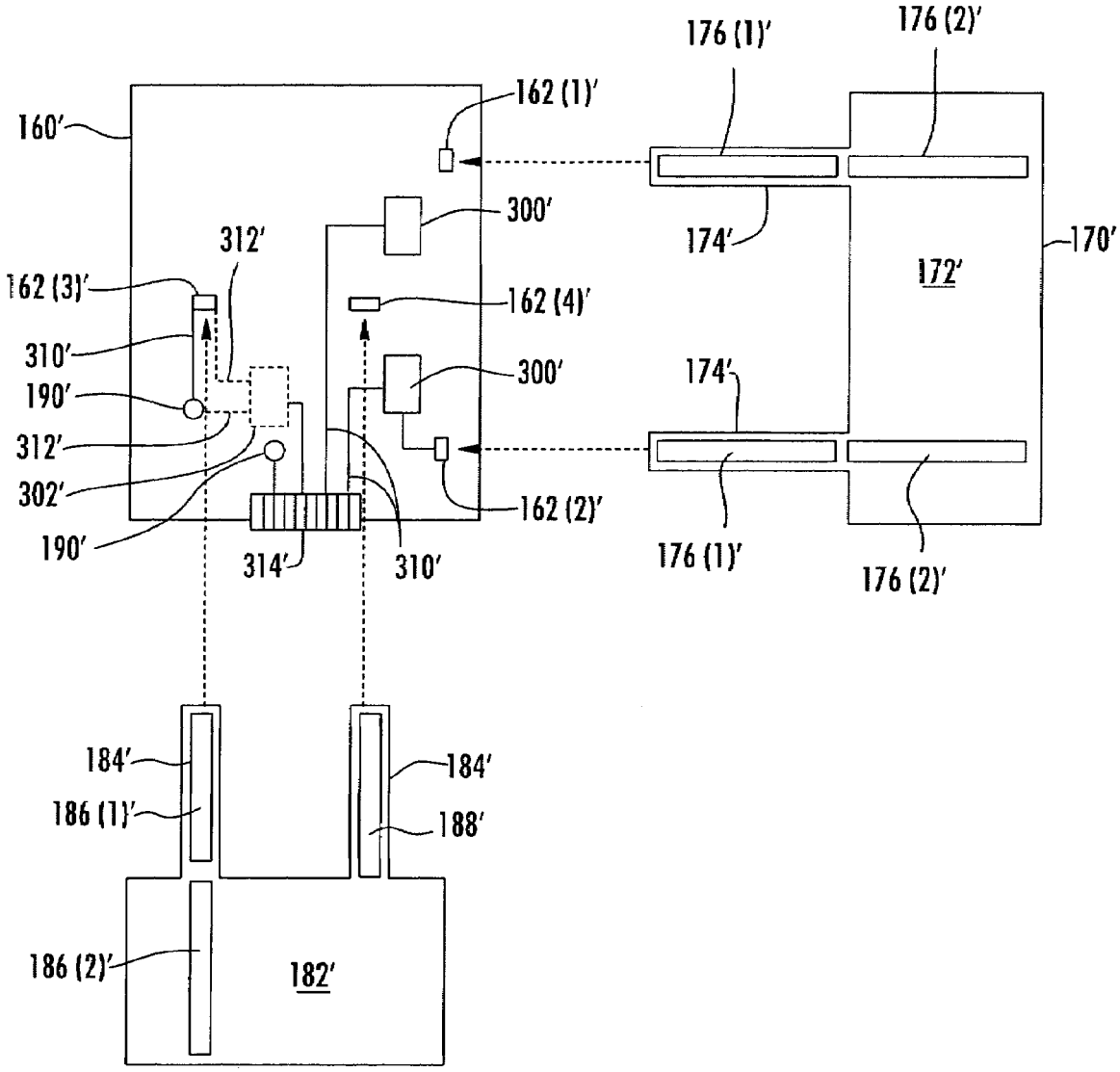
FIG. 5 is a view of another embodiment of the two-dimensional structures shown in FIG. 2 along with electrical components positioned thereon.
Figure 6A:
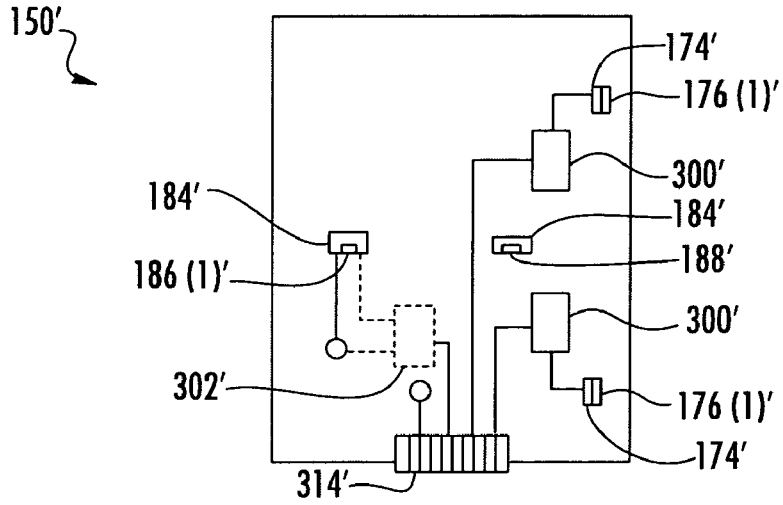
FIGS. 6*a*-6*c* are top and side views of the three-dimensional antenna array assembled from the two-dimensional structures shown in FIG. 5.
Figure 6B:
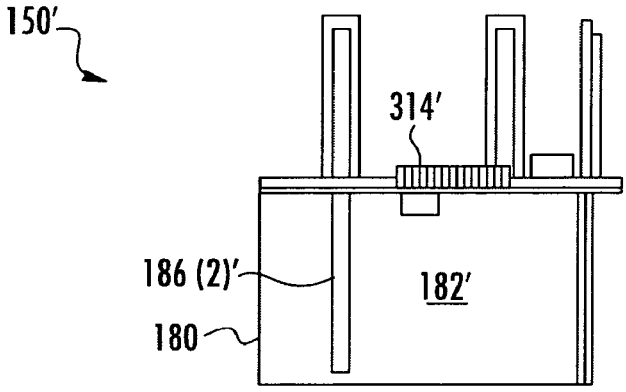
Figure 6C:
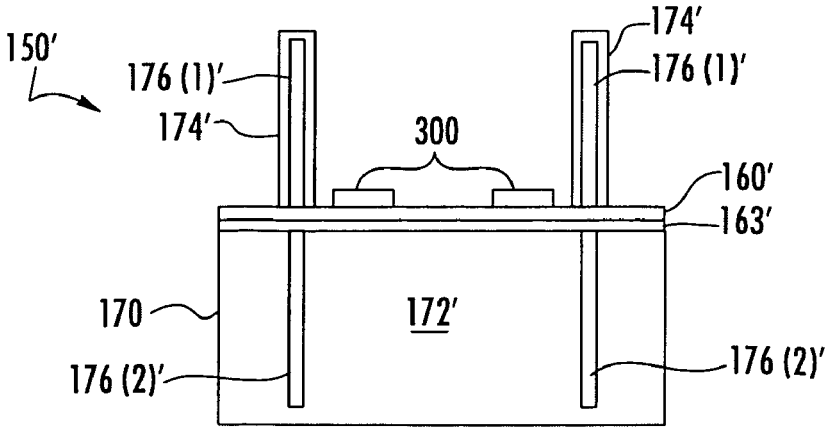

Top and sides views of the assembled antenna structure 150 are provided in FIGS. 4*a*-4*c*. The illustrated three-dimensional antenna array 150 is thus formed using two-dimensional structures 160, 170 and 180. Each two dimensional structure 160, 170 and 180 implements as many of the antenna parts as practical to reduce the overall piece count, which facilitates low cost fabrication and assembly. Appropriate electrical connections are made to fit the two-dimensional structures 160, 170 and 180 together. The final structure is rigid and not as prone to damage as the antenna array 50 shown in FIG. 1.

There are a number of techniques that may be used to electrically connect the antenna elements 176, 186 and 188 to various electrical components mounted or formed on the ground plane 160 and/or dielectric substrate 163 carrying the ground plane. These techniques include 1) solder bead along the lines of contact, 2) the epoxy used to put rigidity in the antenna array structure can be conductive where appropriate, and 3) with the proper overlapping of electrical traces over the edges of the antenna boards, press fitting can be utilized.

Press fitting is a very cost effective and a quick to assemble methodology. There are several methods to enable this approach. When removing material to produce the required cutouts, the electrical traces are undercut to have then extend over the cutout. Another method is when depositing material after the cutouts have been made. Here, the deposited material is applied in such a manner that it extends over the cutout. This is preferably into the cutout if also possible. A third method is to insert press fit electrically conductive inserts in the cutouts. These have lips which extend over the face of the circuit and make contact with any conductor they touch. The method ends at Block 216.

Another embodiment of the two-dimensional structures 160', 170' and 180' shown in FIG. 2 along with electrical components positioned thereon will now be discussed with reference to FIG. 5 and FIGS. 6*a*-6*c*. Antenna element 188' has now been formed on an outwardly extending second leg 184' instead of on the support section 182'.

Electrical components 300' are mounted or formed on the top side of the ground plane 160', and an electrical component 302' is mounted or formed on a back side of the ground plane. The appropriate conductive paths 310' are also formed on the ground plane 160' for electrically connecting the electrical components 300', 302' to the various antenna elements 176', 186'and 188'. One or more second conductive paths 312' may be formed on the dielectric substrate 163' carrying the ground plane 160'. Conductive vias 190'are used to connect the conductive paths 310', 312' between the two sides of the ground plane 160'. Certain conductive paths and the electrical components 300', 302' are connected to a connector 314'.

In both of the illustrated antenna arrays 150 and 150', N antenna elements 176', 186' and 188' are formed, where N=4. In this embodiment, the N antenna elements are formed so that at least one of the elements comprises an active antenna element 188' and up to N−1 of the elements comprise passive antenna elements 176', 186'so that the antenna array forms a switched beam antenna. In another embodiment, the N antenna elements comprising N active antenna elements so that the antenna array forms a phased array.

The passive antenna elements may be formed as upper conducting elements 176(1)' and 186(1)' and lower conducting elements 176(2)' and 186(2)'. When an upper conducting segment 176(1)', 186(1)' is connected to a respective lower conductive segment 176(2)', 186(2)' via an inductive load, the passive antenna element 176', 186' operates in a reflective mode. This results in radio frequency (RF) energy being reflected back from the passive antenna element 176', 186' towards its source, i.e., the active antenna element 188'.

When the upper conductive segment 176(1)', 186(1)' is connected to a respective lower conductive segment 176(2)', 186(2)' via a capacitive load, the passive antenna element 176', 186' operates in a directive mode. This results in RF energy being directed toward the passive antenna element 176', 186' away from the active antenna element 188'.

The inductive and capacitive loads are provided by the electrical components 300', 302'. An active electrical component may also be connected to the active antenna element 188'. Such active devices include amplifiers and a receiver or a transceiver, for example.

The ground plane 160'/dielectric substrate 163' in general may be populated by any circuit component normally associated with circuit board construction. Although not shown, the antenna array 150, 150' also includes switches for switching between the inductive and capacitive loads, a switch controller, and a driver circuit for providing logic control signals to the switch controller.

While it is desirable cost wise to print as many of the electrical components as possible, certain electrical components may not be practical via this technique. For instance, switches of sufficient speed or low resistance may need to be built in discrete components. These electrical components would be placed and attached to the ground plane 160'/dielectric substrate 163' prior to the antenna boards 170', 180' being assembled thereto. The connections to the printed components could be done by using the printing process to lay a layer on the electrical pins of the type often found on surface mount integrated circuits with extended metal parallel to the plane of the platform.

When electrical components 300', 302' are mounted on the ground plane 160'/dielectric substrate 163', noise may be generated for interfering with signal reception/transmission. To reduce noise interference, multilayer circuit boards may be used for interconnecting the electrical components 300', 302' with the conductive paths 310' and 312', for example. These multilayer boards provide isolation between the antenna elements 176', 186' and 188' and the electrical components 300', 302'.

Many modifications and other embodiments of the invention will come to the mind of one skilled in the art having the benefit of the teachings presented in the foregoing descriptions and the associated drawings. In addition, other features relating to three-dimensional antenna fabrication are disclosed in the copending patent application filed concurrently herewith and assigned to the assignee of the present invention and is entitled THREE DIMENSIONAL ANTENNA FABRICATION FROM A TWO-DIMENSIONAL STRUCTURE, Ser. No. 11/344,283, the entire disclosure of which is incorporated herein in its entirety by reference. Therefore, it is understood that the invention is not to be limited to the specific embodiments disclosed, and that modifications and embodiments are intended to be included within the scope of the appended claims.

That which is claimed is:

1. A method for making an antenna array comprising:

forming a ground plane having a plurality of spaced apart openings extending therethrough;

forming at least one first antenna board having a first support section and a plurality of spaced apart first legs extending outwardly from the first support section;

forming a plurality of first antenna elements on the plurality of outwardly extending first legs of the first antenna board;

forming a second antenna board having a second support section and at least one second leg extending outwardly from the second support section;

forming at least one second antenna element on the at least one outwardly extending second leg of the second antenna board;

inserting the plurality of outwardly extending first legs through a corresponding number of openings in the ground plane so that the first support section is on one side of the ground plane and the plurality of outwardly extending first legs is on an opposite side of the ground plane; and inserting the at least one outwardly extending second leg through another one of the plurality of openings in the ground plane so that the second support section is on one side of the ground plane and the at least one second antenna element is on an opposite side of the ground plane.

2. A method according to claim 1 wherein for the at least one first antenna board, each first antenna element is divided into upper and lower conducting elements, with the upper conducting element being on a respective one of the plurality of first legs and the lower conducting element being on a portion of the first support section opposite the respective outwardly extending first leg.

3. A method according to claim 2 wherein the first support section is continuous between the portions of the first support sections opposite the plurality of outwardly extending first legs.

4. A method according to claim 1 wherein for the second antenna board, the at least one second antenna element is divided into upper and lower conducting elements, with the upper conducting element being on the at least one outwardly extending second leg and the lower conducting element being on a portion of the second support section opposite the at least outwardly extending second leg.

5. A method according to claim 1 wherein for the second antenna board, the at least one outwardly extending second leg comprises a pair of outwardly extending second legs, with a respective second antenna element formed on each outwardly extending second leg, and one of the second antenna elements comprises an active antenna element and the other second antenna element comprises a passive antenna element.

6. A method according to claim 1 wherein for the second antenna board, the at least one second antenna element formed on the at least one outwardly extending second leg comprises a passive antenna element divided into upper and lower conducting elements, with the lower conducting element being on the at least one outwardly extending second leg and the upper conducting element being on a portion of the second support section opposite the at least one outwardly extending second leg; and wherein forming the second antenna board further comprises forming an alignment section extending from the second support section, the alignment section to be inserted into another one of the openings in the ground plane when the at least one outwardly extending second leg is inserted through the another one of the openings in the ground plane; and further comprising forming an active antenna element on a portion of the second support section opposite the alignment section.

7. A method according to claim 6 wherein the second support section is continuous between the portions of the second support section opposite the at least one outwardly extending second leg and the alignment section.

8. A method according to claim 1 wherein the first and second antenna boards are orthogonal to one another when their respective first and second support sections are contacting the ground plane.

9. A method according to claim 8 wherein the first and second antenna boards are contacting one another for forming a T-shaped arrangement.

10. A method according to claim 1 further comprising providing at least one electrical component and at least one connector on the ground plane, the at least one electrical component being connected to at least one of the first and second antenna elements.

11. A method according to claim 10 wherein one of the first and second antenna elements comprises an active antenna element having an RF input associated therewith, and another one of the first and second antenna elements comprises a passive antenna element; and wherein the at least one electrical component comprises an impedance element that is selectively connectable to the passive antenna element for antenna beam steering.

12. A method according to claim 11 wherein the at least one electrical component further comprises a switch for selectively connecting the passive antenna element to the impedance element.

13. A method according to claim 10 wherein the at least one electrical component comprises at least one of a receiver and a transmitter so that at least one first and second antenna elements connected thereto comprises an active antenna element.

14. A method according to claim 1 wherein the first and second antenna elements comprise active antenna elements so that the antenna array forms a phased array.

15. A method according to claim 1 wherein the first and second antenna elements comprise at least one active antenna element and a plurality of passive antenna elements for forming a switched beam antenna.

16. An antenna array comprising:

a ground plane having a plurality of spaced apart openings extending therethrough;

at least one first antenna board having a first support section and a plurality of spaced apart first legs extending outwardly from the first support section, said plurality of outwardly extending first legs inserted through a corresponding number of openings in said ground plane so that the first support section is on one side of said ground plane and the plurality of outwardly extending first legs is on an opposite side of said ground plane;

a plurality of first antenna elements on the plurality of outwardly extending first legs;

a second antenna board having a second support section and at least one second leg extending outwardly from the second support section, said at least one outwardly extending second leg inserted through another one of the plurality of openings in said ground plane so that the second support section is on one side of said ground plane and the at least one outwardly extending second leg is on an opposite side of said ground plane; and at least one second antenna element on said at least one outwardly extending second leg.

17. An antenna array according to claim 16 wherein for said at least one first antenna board, each first antenna element is divided into upper and lower conducting elements, with the upper conducting element on a respective one of said plurality of outwardly extending first legs and the lower conducting element on a portion of said first support section opposite said respective outwardly extending first leg.

18. An antenna array according to claim 17 wherein said first support section is continuous between the portions of said first support section opposite said plurality of outwardly extending first legs.

19. An antenna array according to claim 16 wherein for said second antenna board, said at least one second antenna element is divided into upper and lower conducting elements, with the upper conducting element on said at least one outwardly second leg and the lower conducting element on a portion of said second support section opposite said at least one outwardly extending second leg.

20. An antenna array according to claim 16 wherein for said second antenna board, said at least one outwardly extending second leg comprises a pair of outwardly extending second legs, with a respective second antenna element on each outwardly extending second leg, and one of said second antenna elements comprising an active antenna element and said other second antenna element comprising a passive antenna element.

21. An antenna array according to claim 16 wherein for said second antenna board, said at least one second antenna element formed on said at least one outwardly extending second leg comprises a passive antenna element divided into upper and lower conducting elements, with the lower conducting element on said at least one outwardly extending second leg and the upper conducting element on a portion of said second support section opposite the at least one outwardly extending second leg; wherein the second antenna board further comprises an alignment section extending from said second support section, said alignment section inserted into another one of the openings in said ground plane when said at least one outwardly extending second leg is inserted through the another one of the openings in said ground plane; and further comprising an active antenna element on a portion of the second support section opposite the alignment section.

22. An antenna array according to claim 21 wherein said second support section is continuous between the portions of the second support section opposite said outwardly extending second leg and the alignment section.

23. An antenna array according to claim 16 wherein said first and second antenna boards are orthogonal to one another when their respective first and second support sections are contacting said ground plane.

24. An antenna array according to claim 23 wherein said first and second antenna boards are contacting one another for forming a T-shaped arrangement.

25. An antenna array according to claim 16 further comprising at least one electrical component and at least one connector on said ground plane, said at least one electrical component connected to at least one of said first and second antenna elements.

26. An antenna array according to claim 25 wherein one of said first and second antenna elements comprises an active antenna element having an RE input associated therewith, and another one of said first and second antenna elements comprises a passive antenna element; and wherein said at least one electrical component comprises an impedance element that is selectively connectable to said passive antenna element for antenna beam steering.

27. An antenna array according to claim 26 wherein said at least one electrical component further comprises a switch for selectively connecting said passive antenna element to said impedance element.

28. An antenna array according to claim 26 wherein said at least one electrical component comprises at least one of a receiver and a transmitter receiver so that said at least one first and second antenna elements connected thereto comprises an active antenna element.

29. An antenna array according to claim 16 wherein said first and second antenna elements comprise active antenna elements so that the antenna array forms a phased array.

30. An antenna array according to claim 16 wherein said first and second antenna elements comprise at least one active antenna element and a plurality of passive antenna elements for forming a switched beam antenna.

* * * * *